US007344090B2

(12) United States Patent
Sayar

(10) Patent No.: US 7,344,090 B2
(45) **Date of Patent: *Mar. 18, 2008**

(54) ASYMMETRIC FLUIDIC FLOW CONTROLLER ORIFICE DISC FOR FUEL INJECTOR

(75) Inventor: Hamid Sayar, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 38 days.

This patent is subject to a terminal disclaimer.

(21) Appl. No.: 10/972,651

(22) Filed: Oct. 26, 2004

(65) Prior Publication Data

US 2005/0087628 A1 Apr. 28, 2005

Related U.S. Application Data

(60) Provisional application No. 60/514,779, filed on Oct. 27, 2003.

(51) Int. Cl.
*F02D 1/06* (2006.01)

(52) U.S. Cl. ..... 239/5; 239/533.12; 239/533.2; 239/494; 239/497; 239/601; 239/598

(58) Field of Classification Search ..... 239/596, 239/494, 497, 601, 598, 533.12, 533.2
See application file for complete search history.

(56) References Cited

U.S. PATENT DOCUMENTS

| | | | | |
|---|---|---|---|---|
| 1,693,931 | A | 12/1928 | Lowe | |
| 2,493,209 | A | 1/1950 | Simmons | |
| 4,040,396 | A | 8/1977 | Tomita | |
| 5,586,726 | A | 12/1996 | Furuya et al. | |
| 5,762,272 | A * | 6/1998 | Tani et al. | 239/543 |
| 6,065,691 | A | 5/2000 | West | |
| 6,065,692 | A | 5/2000 | Brinn, Jr. | |
| 6,089,473 | A * | 7/2000 | Keim | 239/533.12 |
| 6,102,299 | A | 8/2000 | Pace et al. | |
| 6,161,782 | A | 12/2000 | Heinbuck et al. | |
| 6,357,677 | B1 | 3/2002 | Ren et al. | |
| 6,848,635 | B2 * | 2/2005 | Xu | 239/533.12 |
| 2003/0234302 | A1 | 12/2003 | Varble et al. | |

OTHER PUBLICATIONS

Malvern Products, Spraytec Droplet Size Analyzer, www.malvern.co.uk, Oct. 19, 2004, pp. 1-3.

* cited by examiner

*Primary Examiner*—Dinh Q. Nguyen

(57) ABSTRACT

A fuel injector is described. The fuel injector includes an inlet, outlet, seat, closure member, and a metering orifice disc. The metering orifice disc is disposed between the seat and the outlet. The metering orifice disc includes an outer wall having a surface that defines first and second outer chords generally about the longitudinal axis A-A. The first outer chord intersects the second chord and has a length different than the length of the second outer chord. The metering orifice disc includes an inner wall having a surface that defines first and second inner chords. The first and second inner chords extend generally transverse to the longitudinal axis A-A. The first inner chord intersects the second inner chord. The first inner chord has a length different than the length of the second inner chord. Methods of atomization and targeting are also described.

26 Claims, 4 Drawing Sheets

FIG. 3A
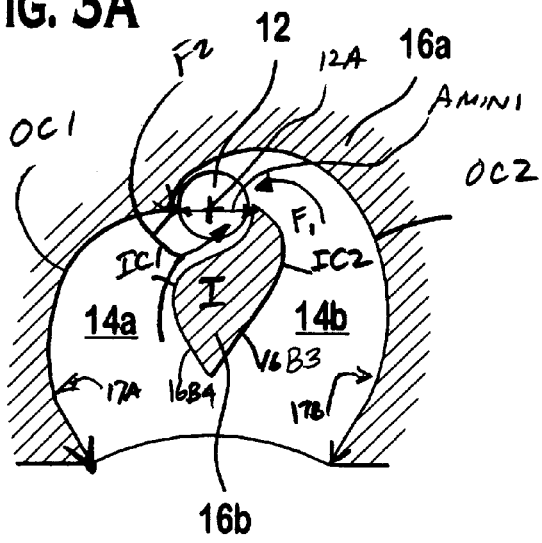
FIG. 3B
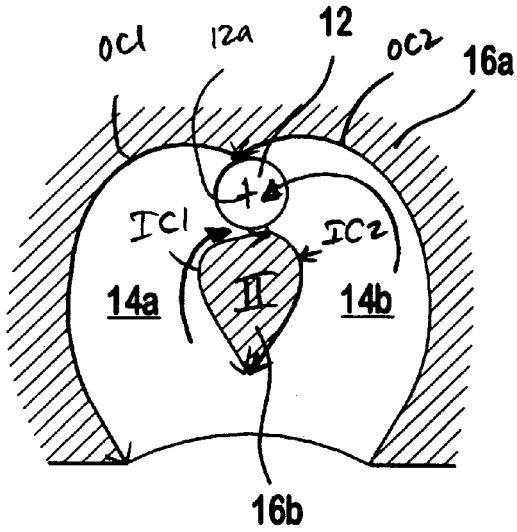
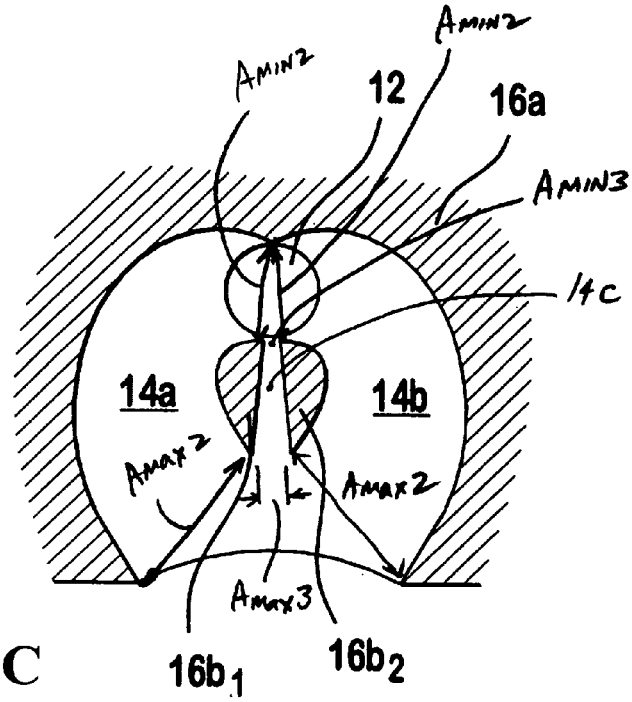
FIG. 3C

ASYMMETRIC FLUIDIC FLOW CONTROLLER ORIFICE DISC FOR FUEL INJECTOR

This application claims the benefits of U.S. provisional patent application Ser. No. 60/514,779 entitled "Fluidic Flow Controller Orifice Disc," filed on 27 Oct. 2003 , which provisional patent application is incorporated herein by reference in its entirety into this application.

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electro-magnetic fuel injector typically utilizes a solenoid assembly to supply an actuating force to a fuel metering assembly. Typically, the fuel metering assembly is a plunger-style closure member which reciprocates between a closed position, where the closure member is seated in a seat to prevent fuel from escaping through a metering orifice into the combustion chamber, and an open position, where the closure member is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration. Thus, it is believed that there is a need in the art for a fuel injector that would alleviate the drawbacks of the conventional fuel injector in providing spray targeting and atomizing of fuel flow with minimal modification of a fuel injector.

SUMMARY OF THE INVENTION

The present invention provides a fuel injector that includes an inlet, outlet, seat, closure member, and a metering orifice disc. The inlet and outlet include a passage extending along a longitudinal axis from the inlet to the outlet, the inlet being communicable with a flow of fuel. The seat is disposed in the passage proximate the outlet. The seat includes a sealing surface that faces the inlet and a seat orifice extending through the seat from the sealing surface along the longitudinal axis A-A. The closure member is reciprocally located between a first position displaced from the seat, and a second position contiguous the sealing seat surface of the seat to form a seal that precludes fuel flow past the closure member. The metering orifice disc is disposed between the seat and the outlet. The metering orifice disc includes: a generally planar surface, a plurality of metering orifices that extends through the generally planar surface, and first and second walls. The plurality of metering orifices extends through the generally planar surface. The metering orifices are located radially outward of the seat orifice. Each metering orifice includes an internal wall surface that defines a center of the metering orifice. The metering orifice disc includes an outer wall having a surface that defines first and second outer chords generally about the longitudinal axis A-A. The first outer chord intersects the second chord and has a length different than the length of the second outer chord. The metering orifice disc includes an inner wall having a surface that defines first and second inner chords. The first and second inner chords extend generally transverse to the longitudinal axis A-A. The first inner chord intersects the second inner chord. The first inner chord has a length different than the length of the second inner chord.

In yet another aspect, a fuel injector is provided. The fuel injector includes an inlet, outlet, seat, closure member, and a metering orifice disc. The inlet and outlet include a passage extending along a longitudinal axis from the inlet to the outlet, the inlet being communicable with a flow of fuel. The seat is disposed in the passage proximate the outlet. The seat includes a sealing surface that faces the inlet and a seat orifice extending through the seat from the sealing surface along the longitudinal axis A-A. The closure member is reciprocally located between a first position displaced from the seat, and a second position contiguous the sealing seat surface of the seat to form a seal that precludes fuel flow past the closure member. The metering orifice disc is disposed between the seat and the outlet. The metering orifice disc includes: a generally planar surface, a plurality of metering orifices that extends through the generally planar surface, and first and second walls. The plurality of metering orifices extends through the generally planar surface. The metering orifices are located radially outward of the seat orifice. Each metering orifice includes an internal wall surface that defines a center of the metering orifice. The outer wall has a first outer wall portion closest to the longitudinal axis and a second outer wall portion closest to the center of the metering orifice; and an inner wall having first and second inner wall portions, each of the first and second inner wall portions including a first portion furthest from the center of the metering orifice and a second portion closest to the center of the metering orifice. Each of the first and second inner walls confronts the outer wall to define a channel that has a first distance between the first outer wall portion and the first portion being greater than a second distance between the second outer wall portion and second portion. The first and second inner wall portions are spaced apart between respective first portions to define a third distance greater than a fourth distance between respective second portions.

In yet a further aspect of the present invention, a method of atomizing fuel flow through at least one metering orifice of a fuel injector is provided. The fuel injector has an inlet and an outlet and a passage extending along a longitudinal axis therethrough the inlet and outlet. The outlet has a closure member, seat and a metering orifice disc. The seat has a seat orifice. The closure member occludes a flow of fuel through seat orifice. The metering orifice disc being disposed between the seat and the outlet. The metering orifice disc includes at least one metering orifice that extends along the longitudinal axis through the generally planar surface to define a perimeter having a centerline. The method can be achieved by: flowing first and second portions of fuel generally simultaneously away from the longitudinal axis towards the at least one metering orifice; and directing one of the first and second portions of fuel along the first and second wall surfaces to arrive at the perimeter of the metering orifice at a different time interval than the other of the first and second portions of fuel.

In yet a further aspect of the present invention, a method of targeting fuel flow through a metering orifice disc of a fuel injector is provided. The fuel injector has an inlet and an outlet and a passage extending along a longitudinal axis therethrough the inlet and outlet. The outlet has a closure member, seat and a metering orifice disc. The seat has a seat orifice. The closure member occludes a flow of fuel through seat orifice. The metering orifice disc being disposed between the seat and the outlet. The metering orifice disc includes at least one metering orifice that extends along the longitudinal axis through the generally planar surface to define a centerline. The method can be achieved by: impacting first and second portions of a fuel flow proximate the at least one metering orifice disposed outward of the seat orifice; and accelerating the first and second portions of the fuel flow through the at least one metering orifice to the outlet of the fuel injector at an oblique angle with respect to the longitudinal axis A-A.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

Figure 2:
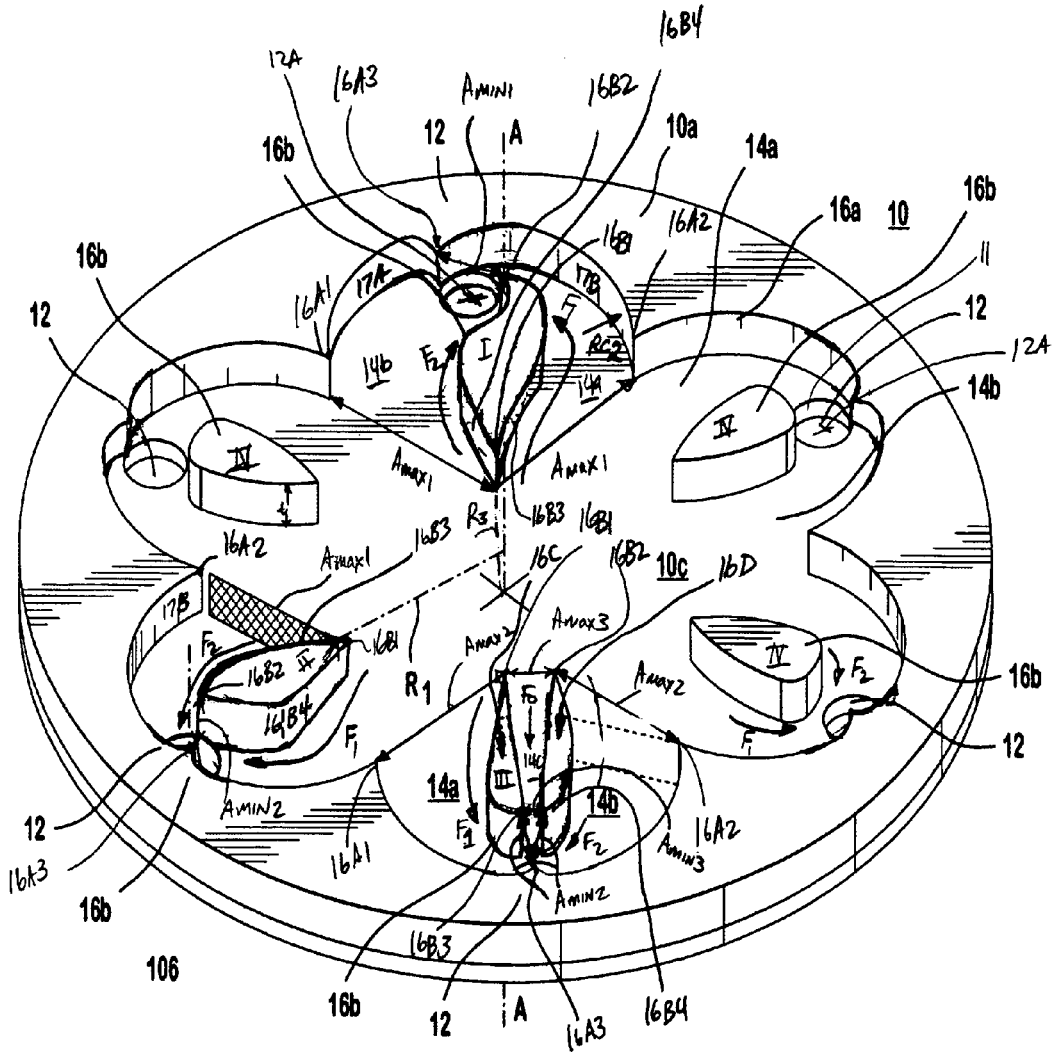
FIG. 2 illustrates a perspective view of a preferred embodiment of a metering orifice disc for use in a fuel injector.

FIGS. 3A, 3B, and 3C illustrate a top view of the divider configurations I-III of FIG. 2.

DETAILED DESCRIPTION OF THE PREFERRED EMBODIMENTS

Figure 1A:
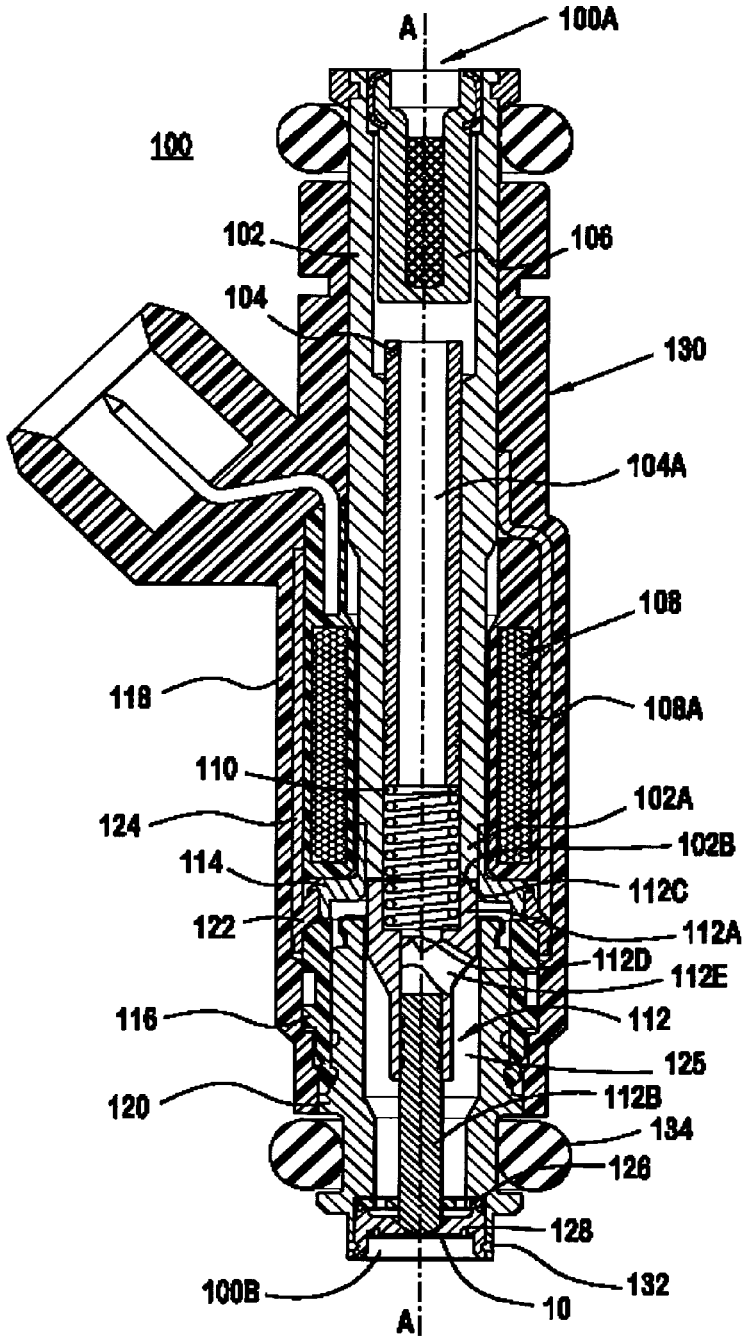
FIG. 1A illustrates a cross-sectional view of the fuel injector for use with the metering orifice discs of FIG. 2.

FIGS. 1-3 illustrate the preferred embodiments, including, as illustrated in FIG. 1A, a fuel injector 100 that utilizes a metering orifice disc 10 located proximate the outlet of the fuel injector 100.

As shown in FIG. 1A, the fuel injector 100 has a housing that includes an inlet tube 102, adjustment tube 104, filter assembly 106, coil assembly 108, biasing spring 110, armature assembly 112 with an armature 112A and closure member 112B, non-magnetic shell 114, a first overmold 116, second overmold 118, a body 120, a body shell 122, a coil assembly housing 124, a guide member 126 for the closure member 112A, a seat assembly 128, and the metering orifice disk 10.

Armature assembly 112 includes a closure member 112A. The closure member 112A can be a suitable member that provides a seal between the member and a sealing surface 128C of the seat assembly 128 such as, for example, a spherical member or a closure member with a hemispherical surface. Preferably, the closure member 112A is a closure member with a generally hemispherical end. The closure member 112A can also be a one-piece member of the armature assembly 112.

Coil assembly 120 includes a plastic bobbin on which an electromagnetic coil 122 is wound. Respective terminations of coil 122 connect to respective terminals that are shaped and, in cooperation with a surround 118A, formed as an integral part of overmold 118, to form an electrical connector for connecting the fuel injector 100 to an electronic control circuit (not shown) that operates the fuel injector 100.

Inlet tube 102 can be ferromagnetic and includes a fuel inlet opening at the exposed upper end. Filter assembly 106 can be fitted proximate to the open upper end of adjustment tube 104 to filter any particulate material larger than a certain size from fuel entering through inlet opening 100A before the fuel enters adjustment tube 104.

In the calibrated fuel injector 100, adjustment tube 104 can be positioned axially to an axial location within inlet tube 102 that compresses preload spring 110 to a desired bias force. The bias force urges the armature/closure to be seated on seat assembly 128 so as to close the central hole through the seat. Preferably, tubes 110 and 112 are crimped together to maintain their relative axial positioning after adjustment calibration has been performed.

After passing through adjustment tube 104, fuel enters a volume that is cooperatively defined by confronting ends of inlet tube 102 and armature assembly 112 and that contains preload spring 110. Armature assembly 112 includes a passageway 112E that communicates volume 125 with a passageway 104A in body 130, and guide member 126 contains fuel passage holes 126A. This allows fuel to flow from volume 125 through passageways 112E to seat assembly 128, shown in the close-up of FIG. 1B.

Figure 1B:
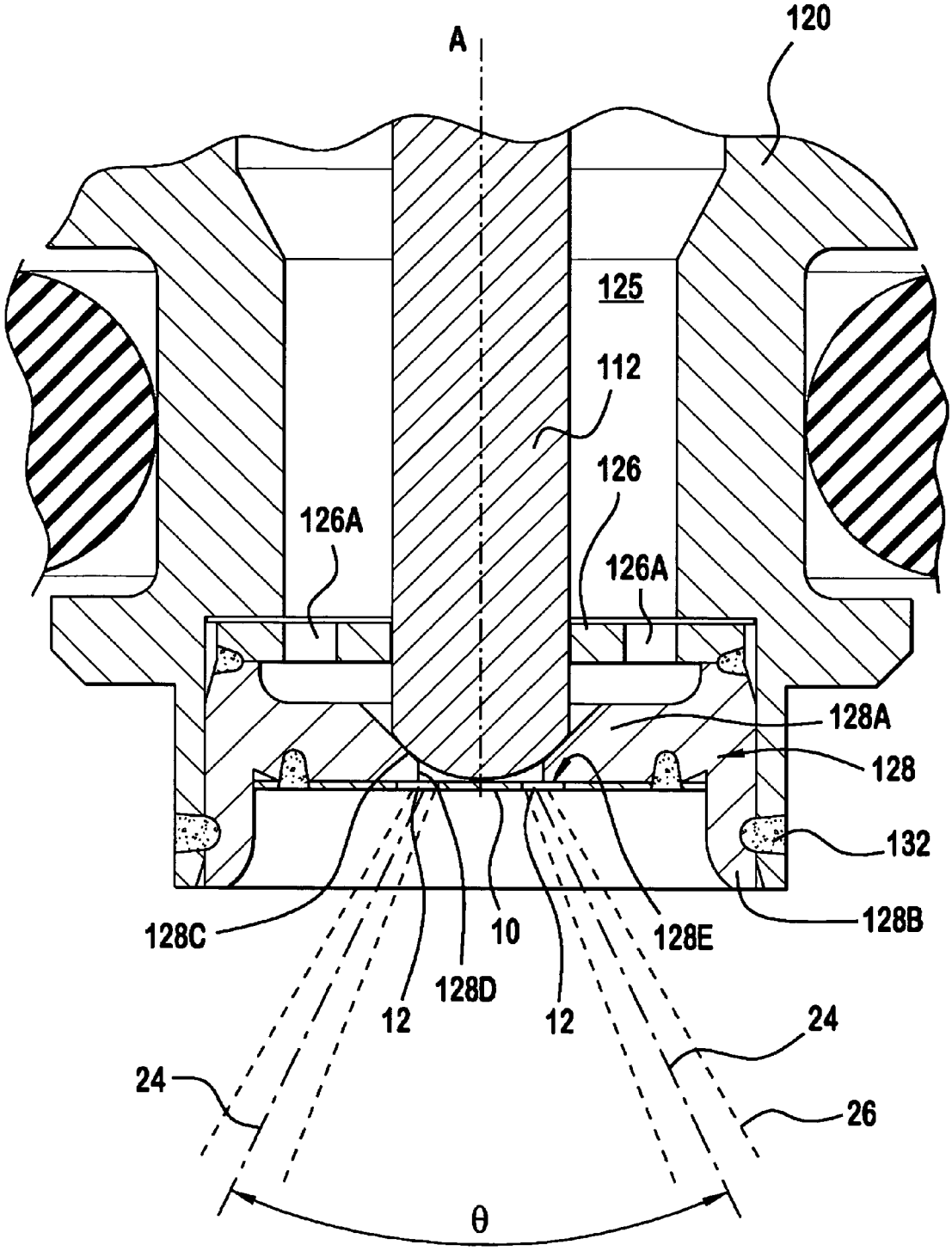
FIG. 1B illustrates a close-up cross-sectional view of the fuel outlet end of the fuel injector of FIG. 1A.

In FIG. 1B, the seat assembly 128 includes a seat body 128A with a seat extension 128B. The seat extension 128B can be coupled to the body 120 with a weld 132 that is preferably welded from an outer surface of the body 120 to the seat extension 128B. The seat body 128A is coupled to a guide disc 126 with flow openings 126A. The seat body 128A includes a seat orifice 128D, preferably having a right-angle cylindrical wall surface with a generally planar face 128E at the bottom of the seat body 128A. The seat body 128A is coupled to the metering orifice disc 10 by a suitable attachment technique, preferably by a weld extending from the second surface 10B of the disc 10 through first surface 10A and into the generally planar face 128E of the seat body 128A. The guide disk 126, seat body 128A and metering orifice disc 10 can form the seat assembly 128, which is coupled to the body 120. Preferably, the seat body 128A and the metering orifice disc 10 form the seat assembly 128. It should be noted here that both the valve seat assembly 128 and metering orifice disc 10 can be attached to the body 120 by a suitable attachment technique, including, for example, laser welding, crimping, and friction welding or conventional welding.

Referring back to FIG. 1A, non-ferromagnetic shell 114 can be telescopically fitted on and joined to the lower end of inlet tube 102, as by a hermetic laser weld. Shell 114 has a tubular neck that telescopes over a tubular neck at the lower end of inlet tube 102. Shell 114 also has a shoulder that extends radially outwardly from neck. Body shell 122 can be ferromagnetic and can be joined in fluid-tight manner to non-ferromagnetic shell 114, preferably also by a hermetic laser weld.

The upper end of body 130 fits closely inside the lower end of body shell 122 and these two parts are joined together in fluid-tight manner, preferably by laser welding. Armature assembly 112 can be guided by the inside wall of body 130 for axial reciprocation. Further axial guidance of the armature/closure member assembly can be provided by a central guide hole in member 126 through which closure member 112A passes. Surface treatments can be applied to at least one of the end portions 102B and 112C to improve the armature's response, reduce wear on the impact surfaces and variations in the working air gap between the respective end portions 102B and 112C.

According to a preferred embodiment, the magnetic flux generated by the electromagnetic coil 108A flows in a magnetic circuit that includes the pole piece 102A, the armature assembly 112, the body 120, and the coil housing 124. The magnetic flux moves across a side airgap between the homogeneous material of the magnetic portion or armature 112A and the body 120 into the armature assembly 112 and across a working air gap between end portions 102B and 112C towards the pole piece 102A, thereby lifting the closure member 112B away from the seat assembly 128. Preferably, the width of the impact surface 102B of pole piece 102A is greater than the width of the cross-section of the impact surface 112C of magnetic portion or armature 112A. The smaller cross-sectional area allows the ferro-magnetic portion 112A of the armature assembly 112 to be lighter, and at the same time, causes the magnetic flux saturation point to be formed near the working air gap between the pole piece 102A and the ferro-magnetic portion 112A, rather than within the pole piece 102A.

The first injector end 100A can be coupled to the fuel supply of an internal combustion engine (not shown). The O-ring 134 can be used to seal the first injector end 100A to the fuel supply so that fuel from a fuel rail (not shown) is supplied to the inlet tube 102, with the O-ring 134 making a fluid tight seal, at the connection between the injector 100 and the fuel rail (not shown).

In operation, the electromagnetic coil 108A is energized, thereby generating magnetic flux in the magnetic circuit. The magnetic flux moves armature assembly 112 (along the axis A-A, according to a preferred embodiment) towards the integral pole piece 102A, i.e., closing the working air gap. This movement of the armature assembly 112 separates the closure member 112B from the sealing surface 128C of the seat assembly 128 and allows fuel to flow from the fuel rail (not shown), through the inlet tube 102, passageway 104A, the through-bore 112D, the apertures 112E and the body 120, between the seat assembly 128 and the closure member 112B, through the opening, and finally through the metering orifice disc 10 into the internal combustion engine (not shown). When the electromagnetic coil 108A is de-energized, the armature assembly 112 is moved by the bias of the resilient member 226 to contiguously engage the closure member 112B with the seat assembly 128, and thereby prevent fuel flow through the injector 100.

Referring to FIG. 2, a perspective view of a preferred metering orifice disc 10 is illustrated. A first metering disk surface 10A is provided with an oppositely facing second metering disk surface 10B. A longitudinal axis A-A extends through both surfaces 10A and 10B of the metering orifice disc 10. A plurality of metering orifices 12 is formed through the metering orifice disc 10 on a recessed third surface 10C. The metering orifices 12 are preferably located radially outward of the longitudinal axis and extend through the metering orifice disc 10 along the longitudinal axis so that the internal wall surface 11 of the metering orifice 12 defines a center 12A of the metering orifice 12. Although the metering orifices 12 are illustrated preferably as having the same configuration, other configurations are possible such as, for example, a non-circular flow opening with different sizes of the flow opening for one or more metering orifices 12.

The metering orifice disc 10 includes two flow channels 14A and 14B provided by two walls 16A and 16B. A first wall 16A surrounds the metering orifices 12. A second wall 16B, acting as a flow divider, is disposed between each metering orifice and the longitudinal axis A-A. The first wall 16A surrounds at least one metering orifice and at least the second wall 16B. The second wall 16B is preferably in the form of a teardrop shape but can be any suitable shape as long as the second wall 16B divides a fuel flow proximate the longitudinal axis A-A into two flow channels 14A and 14 and recombine the fuel flow proximate the metering orifice 12 at a higher velocity than as compared to the velocity of the fuel at the beginning of the second wall 16B.

The second wall 16B can be provided in various configurations. In a first configuration, denoted by Roman numeral "I," the first wall 16A forms a preferably semicircular sector about both the metering orifice 12 and the second wall 16B (FIG. 3A). The first wall 16A has at least one inner end and preferably two inner ends 16A1 and 16A2 farthest from the center of a metering orifice 12 and an outer end 16A3 that is closest to the center 12A of the metering orifice 12. The second wall 16B is located along an axis R1, R2, R3 . . . Rn extending radially from the longitudinal axis A-A. The second wall has an inner end 16B1 farthest from the center of the metering orifice 12 and an outer end 16B2 closest to the center of the metering orifice 12. The utilization of the first and second walls 16A and 16B provides for the two flow channels 14A and 14B converging towards the metering orifice 12. Each flow channel is separated between the first wall 16A and second wall 16B by a plurality of distances $A_{MAX1}, A_2, A_3 \ldots A_{MIN1}$ between them. Suffice to note, each flow channel has a maximum inner distance $A_{MAX1}$ between the respective farthest points 16A1 and 16B1 (from the center of the metering orifice 12) of the walls 16A and 16B and a minimum distance $A_{MIN1}$ therebetween the closest points 16A3 and 16B2 to the center of the metering orifice. The reduction in the distances $A_{MAX1}$ and $A_{MIN1}$ is greater than 10 percent and preferably 100%. Preferably, the distance $A_{MIN}$ is generally the sum of 50 microns and the maximum linear distance extending across the confronting internal wall surfaces 11 of the metering orifice 12. This change in the distances between the maximum points and minimum points of the walls reflects a reduction in the flow area of each channel that reaches a constant value proximate the metering orifice or contiguous to the perimeter of the metering orifice. It is believed that the reduction in cross-sectional area of the flow channel 14A or 14B induces the flow of fuel from the seat orifice 128D to accelerate towards the metering orifice.

Preferably, the flow channel is defined by at least three surfaces: (1) the generally vertical wall surface of the first wall portion 16A, (2) the third surface 10C, and (3) the generally vertical wall surface of the second wall portion 16B. In the most preferred embodiment, a fourth surface is provided by the generally planar seat surface 128E of the seat 128A such that the flow channel 14A or 14B has a generally rectangular cross-section generally parallel to the longitudinal axis A-A.

In the divider configuration I, the divider I has wall surfaces 16B3 and 16B4. The wall surfaces 16B3 and 16B4 define, as viewed in the top view of FIG. 3A, respective first inner chord IC1 and second inner chord IC2 whose lengths are not equal. The first wall portion 16A has preferably two wall surfaces 17A and 17B that define, respectively, first outer chord OC1 and second outer chord OC2, whose lengths are also not equal. Due to the differences in the lengths of the respective inner and outer chords, the first wall 16A and second wall 16B are not symmetric about any axis extending generally radially from the longitudinal axis A-A.

The asymmetric arrangements of both the first wall 16A and second wall 16B are believed to be advantageous for the atomization of fuel proximate the outlet of the fuel injector 100. Specifically, the flow paths F1 and F2 of fuel to the metering orifice 12 via flow channels 14A and 14B are forced to flow around the first and second walls 16A and 16B so that when the flow paths F1 and F2 are recombined proximate the metering orifice 12, they are imparted with a spin before the recombined flow of fuel enters the metering orifice 12 and out towards the outlet of the fuel injector. In this configuration I, the effect of the spin to the fuel flow paths F1 and F2 is believed to reduce the amount of direct impact between the flow paths F1 and F2 as they recombine proximate the fuel metering orifice.

Another asymmetric arrangement is illustrated in the divider configuration II of the second wall 16B, shown here in both FIGS. 2 and 3B. In this configuration, the outer chords OC1 and OC2 are generally equal but the inner chords IC1 and IC2 are not. However, the difference in the magnitude between the inner chords IC1 and IC2 is not to the extent shown in FIG. 3A. It is believed that even though the difference in chord length is slight in configuration II, the flow paths F1 and F2 of the fuel are still imparted with a spin. It is believed that the effect of the spin, in this embodiment, does not outweigh the atomization effect by impingement of the flow paths F1 and F2 against each other proximate the metering orifice.

Another asymmetric arrangement of the second wall portion 16B is illustrated in the divider configuration III, shown here in FIGS. 2 and 3C. In configuration III, the second wall portion 16B is divided into two separate wall portions 16C and 16D. This arrangement provides for three flow paths: a central flow path Fo and two generally symmetric flow paths F1 and F2.

Each of the flow paths F1 and F2 flow through respective channels 14A and 14 and has an inlet area delineated by $A_{MAX2}$ across point 16A1 and 16B1 of respective wall portions 16C and 16D. The point 16A1 is a portion on the first wall portion 16A closest to the longitudinal axis A-A while point 16B1 or 16B2 is a portion on the second wall portion 16B farthest from the center 12A of the metering orifice 12. The flow channel 14A or 14B includes an outlet area to the metering orifice 12 proximate points 16A3 with respect to points 16B3 and 16B4 of wall portions 16C and 16D to define a distance $A_{MIN2}$. Points 16B3 and 16B4 are portions of the wall 16C and 16D closest to the center 12A of the metering orifice 12.

The central flow path Fo is formed by flow channel 14C between the wall portions 16C and 16D with an inlet defined by a distance $A_{MAX3}$ across points 16B1A and 16B1B and an outlet defined by distance $A_{MIN3}$ across points 16B3 and 16B4. The central flow path Fo of the asymmetric configuration III is believed to provide at least one advantage not observed in other configurations of the flow channels described herein. Specifically, the central flow path Fo allows for fuel exiting a metering orifice 12 to be oriented at an angle of separation with respect to the longitudinal axis greater than the angle of separation of the various metering disc configurations described herein. This greater angle of separation is also achieved with the use of metering orifice 12 whose internal wall surface 11 is preferably oriented generally parallel to the longitudinal axis A-A. Hence, even though each of the metering orifices 12 has its wall surface through the metering orifice disc 10 oriented generally parallel to the longitudinal axis, i.e. a "straight" orifice, the fuel flow through the metering orifice 12 with divider configuration III is oblique with respect to the longitudinal axis A-A. This advantage of the preferred embodiments is believed to allow for the benefits of a metering orifice whose internal wall is oriented at an angle relative to the longitudinal axis, i.e., an "angled" orifice rather than a straight orifice, but without the complexity or cost associated with the manufacturing of such angled metering orifice. As compared with a baseline metering orifice disc, the fuel flow from a metering disc 10 that has the divider configuration III and straight metering orifices 12 was observed to have respective centroids of the fuel flow divergent with respect to the longitudinal axis at an included angle θ of about 15-25 degrees (between any two diametrically disposed metering orifices 12) as compared to about 8 degrees for a baseline metering orifice disc that utilizes straight metering orifices 12.

In the preferred embodiment of FIG. 2, the metering orifice 10 can include the divider configurations I, II, III for three of the metering orifices 12 and a symmetric configuration IV for the remainder of the metering orifices 12. The symmetric configuration IV is further disclosed in copending application Ser. No. 10/972,584 filed on Oct. 27, 2004, which copending application is incorporated by reference in its entirety herein.

Referring to FIG. 2, each metering orifice 12 is symmetrically disposed about the longitudinal axis so that the centerline of each metering orifice 12 is generally disposed equiangularly on a virtual bolt circle about the longitudinal axis A-A. The metering orifices 12 can be disposed at different arcuate distances on a virtual bolt circle outside a virtual projection of the seat orifice 128D.

Preferably, each metering orifice 12 is a chemically etched orifice having an effective diameter of about 150-200 microns with the overall diameter of the metering orifice disc 10 being a stainless steel disc of about 5.5 millimeters with an overall thickness of about 100-400 microns and a depth between the recessed surface 10C and the first surface 10A of about 75-300 with preferably 100 microns. As used herein, the term "effective diameter" denotes a diameter of an equivalent circular area for any non-circular area of the metering orifice 12.

It should be noted that a metering orifice disc 10 of FIG. 2 can use the channel configuration of any one of configurations I, II, III, and IV for all of its metering orifices; and a combination of at least any two of configurations I, II, III, and IV for respective metering orifices 12. Furthermore, the divider configurations I, II, III, and IV can be unitary or formed as a monolithic structure with a central portion that projects towards the seat orifice 128D, as disclosed in copending application Ser. No. 10/972,864 , which copending application is incorporated by reference herein in this application. Additionally, the divider configurations I, II, III, and IV described and illustrated herein can also be combined with the multiple flow dividers disclosed in copending application Ser. No. 10/972,585.

The metering orifice disc 10 can be made by any suitable technique and preferably by at least two techniques. The first technique utilizes laser machining to selectively remove materials on the surface of the metering orifice disc 10. The second technique utilizes chemical etching to dissolve portions of the metallic surface of the metering orifice disc 10.

The techniques of making the metering orifice disc or valve seat, the detail of various flow channels and divider configurations for various metering discs or valve seat are provided in copending in copending applications Ser. Nos. 10/972,584 Ser. No. 10/972,585 Ser. No. 10/972,583 Ser. No. 10/972,564 Ser. No. 10/972,652 which the entirety of the copending applications are incorporated herein by reference.

As described, the preferred embodiments, including the techniques of atomization, spray angle targeting and distribution are not limited to the fuel injector described but can be used in conjunction with other fuel injectors such as, for example, the fuel injector sets forth in U.S. Pat. No. 5,494,225 issued on Feb. 27, 1996, or the modular fuel injectors set forth in U.S. Pat. Nos. 6,676,044 and 6,793,162, and wherein all of these documents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A fuel injector comprising:

an inlet and an outlet and a passage extending along a longitudinal axis from the inlet to the outlet, the inlet communicable with a flow of fuel;

a seat disposed in the passage proximate the outlet, the seat including a sealing surface that faces the inlet and a seat orifice extending through the seat from the sealing surface along the longitudinal axis;

a closure member being reciprocally located between a first position displaced from the seat, and a second position contiguous the sealing seat surface of the seat to form a seal that precludes fuel flow past the closure member;

a metering orifice disc disposed between the seat and the outlet, the metering orifice disc including:

a generally planar surface;

a plurality of metering orifices that extends through the generally planar surface, the metering orifices being located radially outward of the seat orifice, each metering orifice including an internal wall surface that defines a center of the metering orifice;

an outer wall having a surface that defines first and second outer chords generally about the longitudinal axis, the first outer chord intersecting the second chord and having a length different than the length of the second outer chord; and an inner wall having a surface that defines first and second inner chords that extend generally transverse to the longitudinal axis, the first inner chord intersecting the second inner chord, the first inner chord having a length different than the length of the second inner chord.

2. The fuel injector of claim 1, wherein the plurality of metering orifices includes at least two metering orifices diametrically disposed on a first virtual circle about the longitudinal axis A-A.

3. The fuel injector of claim 2, wherein the plurality of metering orifices includes at least two metering orifices disposed at a first arcuate distance relative to each other on the first virtual circle.

4. The fuel injector of claim 2, wherein the plurality of metering orifices includes at least three metering orifices spaced at different arcuate distances on the first virtual circle.

5. The fuel injector of claim 1, wherein the generally planar surface, inner and outer walls define two flow channels for each metering orifice.

6. The fuel injector of claim 5, wherein each of the two flow channels includes a surface of the seat that faces the generally planar surface of the metering orifice disc.

7. The fuel injector of claim 5, wherein the first wall includes a first inner wall portion closest to the longitudinal axis and a first outer wall portion closest to the center of the metering orifice, the second wall having a second inner wall portion furthest from the center of the metering orifice and a second outer wall portion closest to the center of the metering orifice, the second wall confronting the first wall to define two channels that converge towards each metering orifice, each channel including a first distance between the first inner wall portion and second inner wall portion being greater than a second distance between the first outer wall portion and second outer wall portion.

8. The fuel injector of claim 7, wherein the second distance comprises from 10% to 90% of the first distance.

9. A fuel injector comprising:

an inlet and an outlet and a passage extending along a longitudinal axis from the inlet to the outlet, the inlet communicable with a flow of fuel;

a seat disposed in the passage proximate the outlet, the seat including a sealing surface that faces the inlet and a seat orifice extending through the seat from the sealing surface along the longitudinal axis;

a closure member being reciprocally located between a first position displaced from the seat, and a second position contiguous the sealing seat surface of the seat to form a seal that precludes fuel flow past the closure member;

a metering orifice disc disposed between the seat and the outlet, the metering orifice disc including:

a generally planar surface;

a plurality of metering orifices that extends through the generally planar surface, the metering orifices being located radially outward of the seat orifice, each of the metering orifices having a center defined by the interior surface of the metering orifice through the disc;

an outer wall having a first outer wall portion closest to the longitudinal axis and a second outer wall portion closest to the center of the metering orifice; and an inner wall having first and second inner wall portions, each of the first and second inner wall portions including a first portion furthest from the center of the metering orifice and a second portion closest to the center of the metering orifice, each of the first and second inner walls confronting the outer wall to define a channel that has a first distance between the first outer wall portion and the first portion being greater than a second distance between the second outer wall portion and second portion, the first and second inner wall portions being spaced apart between respective first portions to define a third distance greater than a fourth distance between respective second portions.

10. The fuel injector of claim 9, wherein the plurality of metering orifices includes at least two metering orifices diametrically disposed on a first virtual circle about the longitudinal axis A-A.

11. The fuel injector of claim 9, wherein the plurality of metering orifices includes at least two metering orifices disposed at a first arcuate distance relative to each other on the first virtual circle.

12. The fuel injector of claim 9, wherein the plurality of metering orifices includes at least three metering orifices spaced at different arcuate distances on the first virtual circle.

13. The fuel injector of claim 12, wherein the generally planar surface, inner and outer walls define three flow channels for each metering orifice.

14. The fuel injector of claim 13, wherein each of the three flow channels includes a surface of the seat that faces the generally planar surface of the metering orifice disc.

15. The fuel injector of claim 14, wherein one of the three flow channels comprises a convergent linear flow channel.

16. The fuel injector of claim 15, wherein the other of the three flow channels comprises curved flow channels.

17. A method of atomizing fuel flow through at least one metering orifice of a fuel injector, the fuel injector having an inlet and an outlet and a passage extending along a longitudinal axis therethrough the inlet and outlet, the outlet having a seat and a metering orifice disc, the seat having a seat orifice, a closure member that occludes a flow of fuel through seat orifice, the metering orifice disc being disposed between the seat and the outlet, the metering orifice disc including having a generally planar surface and at least one metering orifice that extends along the longitudinal axis through the generally planar surface to define a perimeter having centerline, the method comprising:

flowing first and second portions of fuel generally simultaneously away from the longitudinal axis towards the at least one metering orifice; and directing one of the first and second portions of fuel along first and second wall surfaces of the metering disc to arrive at the perimeter of the metering orifice at a different time interval than the other of the first and second portions of fuel.

18. The method of claim 17, wherein the flowing comprises dividing a flow of fuel through the seat orifice into at least two fuel flow paths that extend away from the longitudinal axis towards the metering orifice.

19. The method of claim 17, wherein the directing comprises combining the flow paths proximate each metering orifice located outward of the seat orifice so that the fuel flow paths are atomized proximate the outlet of the fuel injector.

20. The method of claim 19, wherein a portion of the fuel flow is divided into a first flow path along a first chord defined by a wall surface of the metering disc and a second flow path along a second chord defined by the wall surface.

21. The method of claim 20, wherein a portion of the fuel flow is divided into a third flow path along a linear path towards the metering orifice.

22. The method of claim 21, wherein the respective lengths of the first and second chord are generally equal.

23. The method of claim 21, wherein the respective lengths of the first and second chord are different.

24. A method of spray targeting fuel flow through a metering orifice disc of a fuel injector, the fuel injector having an inlet and an outlet and a passage extending along a longitudinal axis A-A therethrough the inlet and outlet, the outlet having a seat and a metering orifice disc, the seat having a seat orifice, a closure member that occludes a flow of fuel through seat orifice, the metering orifice disc being disposed between the seat and the outlet, the metering orifice disc including at least one metering orifice that extends along the longitudinal axis through the generally planar surface to define a centerline, the method comprising:

impacting first and second portions of a fuel flow proximate the at least one metering orifice disposed outward of the seat orifice; and accelerating the first and second portions of the fuel flow through the at least one metering orifice to the outlet of the fuel injector at an oblique angle with respect to the longitudinal axis A-A.

25. The method of claim 24, wherein the accelerating comprises flowing a third portion of the fuel flow along an axis generally transverse to the longitudinal axis A-A.

26. The method of claim 25, wherein the oblique angle comprises an angle of about 10 degrees.

* * * * *